US009683824B2

(12) United States Patent
Bomal et al.

(10) Patent No.: US 9,683,824 B2
(45) Date of Patent: Jun. 20, 2017

(54) ARMING AND SAFETY DEVICE

(71) Applicants: PYROALLIANCE, Les Mureaux (FR); TECHSPACE AERO, Milmort (BE)

(72) Inventors: Jean-Christian Bomal, Melen (BE); Cédric Frippiat, Theux (BE); Christophe Lamontagne, Guerville (FR)

(73) Assignees: PYROALLIANCE, Les Mureaux (FR); TECHSPACE AERO, Milmort Herstal (BE)

( * ) Notice: Subject to any disclaimer, the term of this patent is extended or adjusted under 35 U.S.C. 154(b) by 0 days.

(21) Appl. No.: 14/947,408

(22) Filed: Nov. 20, 2015

(65) Prior Publication Data

US 2016/0146586 A1 May 26, 2016

(30) Foreign Application Priority Data

Nov. 24, 2014 (FR) ..... 14 61338

(51) Int. Cl.
*F42C 15/188* (2006.01)
*F42C 15/40* (2006.01)

(52) U.S. Cl.
CPC ..... *F42C 15/188* (2013.01); *F42C 15/40* (2013.01)

(58) Field of Classification Search
CPC ..... F42C 15/40; F42C 15/188; F42C 15/196
See application file for complete search history.

(56) References Cited

U.S. PATENT DOCUMENTS 3,500,747 A * 3/1970 Parker ..... F42B 3/124 102/254
3,618,527 A 11/1971 Kilmer
3,658,009 A 4/1972 Allen
5,249,526 A * 10/1993 Cooksey ..... F42C 15/44 102/248
5,279,226 A * 1/1994 Ritchie ..... F42C 15/40 102/254
5,375,525 A * 12/1994 Greenslade ..... C06C 5/06 102/254
7,007,606 B1 * 3/2006 Maurer ..... F42C 15/40 102/200

(Continued)

FOREIGN PATENT DOCUMENTS

DE 35 03 013 C1 6/1986

OTHER PUBLICATIONS

Search Report as issued in French Patent Application No. 1461338, dated Oct. 5, 2015.

*Primary Examiner* — Stephen M Johnson
*Assistant Examiner* — Joshua Semick
(74) *Attorney, Agent, or Firm* — Pillsbury Winthrop Shaw Pittman LLP

(57) ABSTRACT

An arming and safety device for a pyrotechnic chain, the device including a housing presenting an inlet zone for a pyrotechnic stream and an outlet zone for the pyrotechnic stream, an arming element housed in the housing between the inlet and outlet zones and adapted to move between a disarmed position in which it blocks the passage of the pyrotechnic stream and an armed position in which it allows the pyrotechnic stream to pass, and an electric motor for driving the arming element. The stator of the electric motor is situated outside the housing, and the rotor is contained entirely inside the housing.

14 Claims, 5 Drawing Sheets

(56) References Cited

U.S. PATENT DOCUMENTS 7,464,648 B2 * 12/2008 Teowee ..... F42C 15/188
102/254
8,689,691 B2 * 4/2014 Rahimi ..... F42C 15/18
102/222

* cited by examiner

ARMING AND SAFETY DEVICE

CROSS-REFERENCE TO RELATED APPLICATIONS

This application claims priority to French Patent Application No. 1461338, filed Nov. 24, 2014, the entire content of which is incorporated herein by reference in its entirety.

FIELD

The present description relates to making pyrotechnic systems safe. More particularly, the present description relates to an arming and safety device for a pyrotechnic chain.

BACKGROUND

Arming and safety devices for a pyrotechnic chain are already known, in particular from U.S. Pat. No. 3,618,527.

In this type of device, the shaft of the motor passes through the housing. The housing is sealed around the motor shaft by dynamic gaskets that are installed very tightly.

Furthermore, known devices generally make use of brush motors instead of electronic control systems. However brush motors present poor reliability; it is known that the brushes of such motors oxidize easily over time, in particular under conditions of very low pressure, specifically in a vacuum environment.

After long periods without being actuated, the arming element can thus remain jammed because of oxidation of the brushes of its electric motor and/or because of adhesion between the motor shaft and the dynamic gaskets that are for sealing the housing.

In order to avoid the motor shaft jamming, it is necessary to have high driving force. Nowadays, in order to achieve this, devices make use of gear motors with spur gears or wormscrews. Increasing the number of parts nevertheless reduces the reliability of a device. It also increases the dimensions and the weight of the device.

Furthermore, increasing the driving force makes it essential for a torque limiter device to be included in order to handle stroke ends.

Consequently, prior art devices are heavy, not very reliable, and expensive.

SUMMARY

An aspect of the present description relates to an arming and safety device for a pyrotechnic chain, the device being of the type including:

- a housing presenting an inlet zone for a pyrotechnic stream and an outlet zone for the pyrotechnic stream;
- an arming element housed in the housing, between the inlet and outlet zones, and adapted to move between a disarmed position in which it blocks the passage of the pyrotechnic stream between the inlet zone and the outlet zone, and an armed position in which it allows the pyrotechnic stream to pass between the inlet zone and the outlet zone; and
- a drive system configured to drive the arming element between its armed position and its disarmed position, the drive system comprising an electric motor having a rotor and a stator.

The arming and safety device of various aspects of the invention is particularly suited for use in the field of aviation in chains for ignition, destruction, or space launcher separation.

One of the aspects of the present invention is to provide an arming and safety device that makes it possible to remedy the above-specified drawbacks of the prior art.

In particular, an aspect of the present invention seeks to provide an arming and safety device that makes it possible to avoid problems of the arming element jamming, in particular after long periods without operation, and that is also simple, reliable, and inexpensive.

This aspect is achieved by an arming and safety device of the above-specified type wherein the stator of the electric motor is situated outside the housing, and the rotor is contained entirely inside the housing.

At least one magnetic drive member of the rotor contained inside the housing is magnetically actuated by the stator through the housing, thereby enabling the arming element to be moved between its armed and disarmed positions.

The housing of the device is beneficially hermetically sealed (fluid-tight), so the stator and the connections associated therewith are not subjected to the extreme pressure and temperature conditions that exist in the inside space of the housing while the device is in operation.

The device of an embodiment of the invention thus does not involve dynamic gaskets of the kind used in prior art devices. The absence of dynamic gaskets—and of the associated friction—reduces the amplitude of the driving force needed for actuating the arming element. The electricity consumed for actuation purposes is thus reduced, and the dimensions and the weight of the device are limited. Furthermore, there is no longer any need for a torque-limiting device to manage the ends of strokes.

The absence of dynamic gaskets, and more generally the limited number of parts used in the device, impart better reliability to the device.

Finally, the device of an embodiment of the invention avoids risks of jamming due to oxidation of brushes or to a lack of lubrication after long periods of no actuation.

According to an embodiment, the stator is arranged at the periphery of a portion of the housing surrounding the magnetic drive member of the rotor.

By way of example, the stator comprises at least one coil.

In an example, the magnetic drive member of the rotor may be a permanent magnet secured to or forming a part of the arming element. It can be understood that with this provision the drive member may be an element that is distinct from the arming element, or that it may be formed by the arming element itself, when the arming element is made of an appropriate magnetic material.

In an example, the arming element is suitable for pivoting about an axis.

Below, the axial direction of the device is generally defined as being the direction of the pivot axis of the arming element.

Unless specified to the contrary, a radial direction is defined as being a direction perpendicular to the pivot axis and intersecting the pivot axis.

The arming element is thus provided with a transmission system suitable to transmit the pyrotechnic stream and arranged to be positioned facing inlet and outlet zones when the element is in an angular position corresponding to its armed position, and with a blocking system adapted to block the pyrotechnic stream and arranged to be positioned between the inlet and outlet zones when the element is in an angular position corresponding to its disarmed position.

In an example, the transmission system is formed by a through opening (lateral recess, through hole, etc.) extending in a first direction that is substantially radial, and the blocking system comprises a blocking portion defined in a direction that is at an angle relative to the first direction, the angle being substantially equal to the angle through which the arming element travels.

By way of example, the arming element is pierced by a through hole adapted to be positioned facing the inlet and outlet zones when it is in its armed position, the hole allowing the pyrotechnic stream coming from the inlet zone to pass to the outlet zone. It can be understood that the pyrotechnic stream, which is generally in the form of a detonation wave or a shockwave, can propagate in air inside said through hole.

When the arming element is in its disarmed position, the pyrotechnic stream may for example be stopped by the material constituting the arming element, which does not conduct detonation waves and which is generally a metal.

In particular when the distance between the inlet zone and the outlet zone of the device is large, the system for transmitting the pyrotechnic stream may also comprise a pyrotechnic relay secured to the arming element, e.g. arranged in the through hole in the above-mentioned configuration.

Typically, the arming element passes from its armed position to its disarmed position by pivoting in a disarming direction through an angle generally lying in the range 40° to 140°, in an embodiment in the range 80° to 100°, and in an embodiment substantially equal to 90°. In order to pass from its disarmed position to its armed position, the arming element pivots through the same angle as mentioned above in an arming direction that is opposite from the disarming direction.

The device of an embodiment of the invention generally comprises an abutment system adapted to block movement of the arming element so that the arming element is in abutment when in its armed position and when in its disarmed position.

In an example, the arming and safety device further comprises a position locking system for locking the arming element both in its disarmed position and also in its armed position.

The function of such a locking system is to prevent the arming element moving freely between its armed position and its disarmed position in the absence of the motor being powered electrically.

If the arming element is in its armed position when the power supply to the motor is stopped, then the locking system holds it in the armed position. Likewise, if the arming element is in its disarmed position when the power supply to the motor is stopped, then the locking system holds it in the disarmed position.

By way of example, the locking system comprises a primary magnet secured to the arming element, and a magnetic assembly that is stationary relative to the housing, the magnetic assembly being adapted to co-operate with the primary magnet to urge it magnetically in a bistable system towards a first position in which the arming element is in its armed position or else towards a second position in which the arming element is in its disarmed position.

The primary magnet is generally formed by a permanent magnet that is secured to the arming element or that forms a portion of the arming element when it is made of an appropriate magnetic material.

In a particular example, the primary magnet may be a magnetic drive member of the rotor, co-operating with the stator for driving the arming element.

The magnetic assembly may be positioned equally well inside or outside the housing. For example, it may comprise at least one permanent magnet or an electromagnet powered with direct current (DC).

The magnetic assembly may be adapted to repel the primary magnet magnetically towards its first position and towards its second position. By way of example, the magnetic assembly may comprise a secondary magnet arranged on a radial direction that is angularly situated between the axial directions of the primary magnet when it is in its first position and when it is in its second position.

When performing such locking by repulsion, it is desirable for the arming and safety device to include an abutment system adapted to prevent the arming element from moving while it is in its armed position or in its disarmed position.

In another configuration, the magnetic assembly may be adapted to attract the primary magnet magnetically towards its first position or towards its second position. By way of example, the magnetic assembly may comprise at least two secondary magnets placed to attract the primary magnet respectively towards its first position and towards its second position.

In yet another example, the primary magnet includes an indexing portion and the magnetic assembly comprises the stator, the stator having at least one ring portion made of ferromagnetic material provided with at least one first projection and at least one second projection extending radially towards the inside of the ring, the indexing portion being urged towards one or the other of the projections, the arming element being in its armed position when the indexing portion faces the first projection and in its disarmed position when the indexing portion is facing the second projection.

It can be understood that the indexing portion is a portion of the primary magnet that projects radially outwards (a radial direction being defined as being a direction orthogonal to the pivot axis of the magnet and intersecting that axis). In other words, the minimum radial distance between the stator and the primary magnet is measured between the stator and the indexing portion.

The projecting poles of the stator, formed by the projections or teeth, give rise to a so-called "cogging torque" that tends to bring the rotor into positions of stable equilibrium in which the reluctance of the magnetic circuit defined between the rotor and the stator is minimized. It is known that air presents reluctance that is greater than the reluctance of the ferromagnetic material of the stator. When the indexing portion is situated facing a projection, the path traveled through air by the magnetic induction coming from the rotor is diminished compared with the path traveled by the magnetic induction when the indexing portion is facing a portion of the stator that does not have a tooth. The indexing portion thus tends naturally to align itself with the teeth of the cogged stator and to remain in alignment with them. If the alignment positions of the primary magnet coincide with the armed and disarmed positions of the arming element, it can be understood that the cogging torque contributes to locking the arming element in those two positions.

It is desirable to be able, at any time, to determine reliably the position of the arming element. For this purpose, according to an embodiment, the arming and safety device may include at least one magnetic switch situated outside the housing and adapted to be actuated as a function of the position of the arming element by at least one permanent magnet secured to or forming part of the arming element. The permanent magnet may thus be an auxiliary magnet secured to the arming element, or it may be the arming element itself when it is made of a suitable magnetic material. In a particular example, the permanent magnet may be a magnetic drive member of the rotor. Still more particularly, it may be the primary magnet of the above-mentioned locking system.

The magnetic switch may for example be a flexible blade type switch, commonly known as a reed switch.

In an emergency, in particular in the event of the electric motor failing, it may also be desirable to move the arming element manually.

Beneficially, for this purpose, the arming and safety device comprises manual drive system configured to drive the arming element, the manual drive system being adapted to be decoupled from the arming element in at least one configuration, and in particular when the arming and safety device is in its nominal operating state, in other words other than when actuating the manual drive system (i.e. in an emergency). These provisions serve to eliminate friction forces and torques associated with the dynamic sealing surrounding the manual drive system.

In an example, the manual drive system comprises a handle mounted to pivot about an axis parallel to the pivot axis of the arming element and movable in translation along the direction of said axis between an active position in which it is coupled in rotation with the arming element and a passive position in which it is not coupled to the arming element.

In an example, the manual drive system includes at least one spring continuously urging the handle towards its passive position.

An embodiment of the invention also provides a pyrotechnic chain comprising an arming and safety device as defined above, an upstream segment of the pyrotechnic chain being coupled to the inlet zone of the housing, and a downstream segment of the pyrotechnic chain being coupled to the outlet zone of the housing.

The upstream segment generally comprises a detonator. The downstream segment generally comprises a terminal functional member (actuated by the detonator) and, optionally, a detonation transmission line interposed between the arming and safety device and the terminal member.

Several embodiments are described in the present description. Nevertheless, unless specified to the contrary, the characteristics described with reference to any one embodiment may be applied to any other embodiment.

BRIEF DESCRIPTION OF THE DRAWINGS

The invention can be well understood and its benefits appear better on reading the following detailed description of embodiments given as non-limiting examples. The description refers to the accompanying drawings, in which.

DETAILED DESCRIPTION

Figure 1:
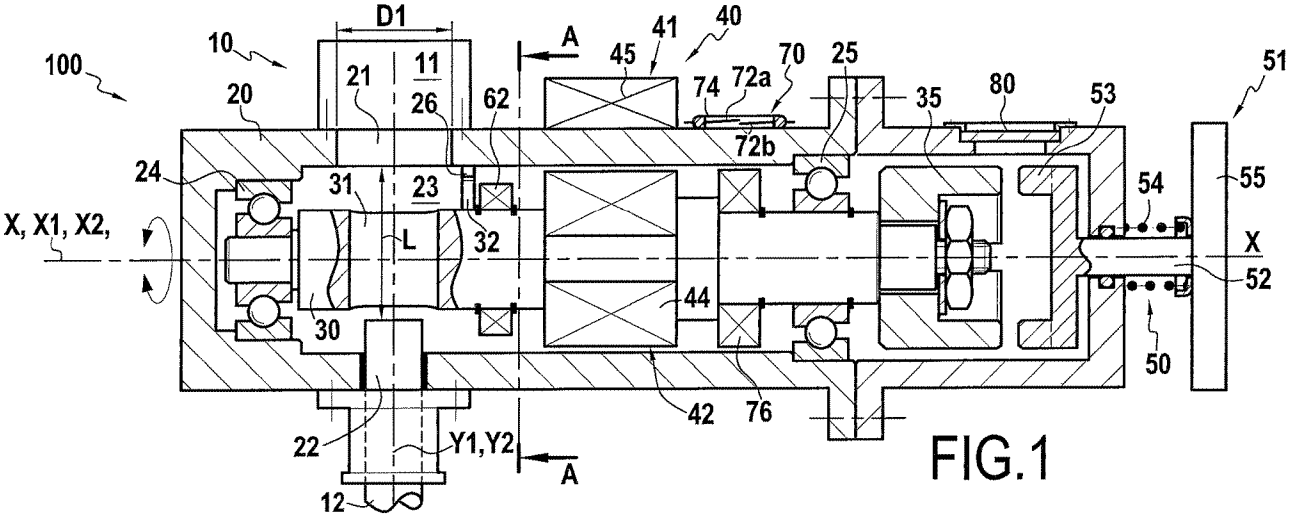
FIG. 1 is a longitudinal section view of a pyrotechnic chain comprising an arming and safety device in a first embodiment of the invention, the arming element of the device being in its armed position.

FIG. 1 shows a pyrotechnic chain 100 comprising:

- an upstream segment in the form, in this example, of a detonator 11;
- a downstream segment in the form, in this example, of a pyrotechnic transmission line 12 configured to transmit the detonation wave from the detonator 11 to one or more target members (not shown), in particular for the purpose of igniting or destroying or separating components, e.g. stages of a space launcher; and
- an arming and safety device 10 (referred to below as the device) in an embodiment of the invention, arranged between the upstream segment (detonator 11) and the downstream segment (pyrotechnic transmission line 12) for the purpose of enabling the pyrotechnic chain 100 to be armed and disarmed in selective manner.

As shown in FIG. 1, the device 10 comprises a housing 20 defining an inside space 23 that is hermetically sealed. The inside space of the housing therefore cannot suffer damage associated with the outside atmosphere.

In the example shown, the housing 20 is cylindrical in shape about an axis X1, and substantially circular in section.

It has an open inlet zone 21 to which the detonator 11 is connected in leaktight manner by means of one or more static gaskets (not shown), and an open outlet zone 22, to which the pyrotechnic transmission line 12 is connected likewise in leaktight manner.

To enable the pyrotechnic stream to reach the downstream segment of the pyrotechnic chain, the length L (referred to below as the crossing length) between the upstream segment and the downstream segment of the transmission chain should generally be less than some limit value, typically substantially equal to the maximum diameter D1 of the element made of pyrotechnic material that constitutes the upstream segment of the pyrotechnic transmission chain (typically the detonator), at its end opening out to the inside of the housing. This length generally lies in the range 2 millimeters (mm) to 10 mm.

To ensure that the crossing length is less than the limit value, it is possible to make provision for the upstream segment 11 and/or the downstream segment 12 of the pyrotechnic chain to project in part into the inside of the housing 20, respectively via the inlet zone 21 and/or the outlet zone 22.

By way of example, in FIG. 1, the pyrotechnic transmission line 12 penetrates in part into the inside space 23 of the housing 20.

The inlet zone 21 and the outlet zone 22 are positioned facing each other along an axis Y1 that is substantially orthogonal to the longitudinal direction X1 of the housing.

The housing 20 houses an arming element 30 that, in the example shown, is in the form of a rod extending along an axis X2 parallel to the axis X1 of the housing, and coinciding therewith in this example (referred to below as the axis X, for purposes of concision).

The arming element 30 could nevertheless present any other appropriate shape. The characteristics described below with reference to the rod 30 are thus also applicable to an arming element of different shape.

The rod 30 is interposed between the inlet and outlet zones 21 and 22.

It is also mounted to pivot about its axis X, by bearings 24 and 25 mounted in the housing 20.

It is thus adapted to pass from a disarmed position in which it blocks passage of a pyrotechnic stream between the inlet zone 21 and the outlet zone 22, to an armed position in which it allows the pyrotechnic stream to pass between said zones, and vice versa.

In the example, the rod 30 is made of a metal material. Nevertheless, more generally, it could be made of any material that is naturally suitable for blocking the passage of the pyrotechnic stream. It could also be made in part only of such a material, the part then being interposed between the inlet and outlet zones.

In order to allow the stream to pass when it is in its armed position, the rod 30 is provided with a transmission system, in the form of a hole 31 passing right through the rod 30 in this example, extending in a direction that is substantially orthogonal to the pivot axis X, in register with the above-mentioned inlet and outlet zones.

When the rod 30 is in its armed position, as shown in FIG. 1, the axis Y2 of the hole is substantially in alignment with the inlet and outlet zones 21 and 22, and a pyrotechnic stream, in other words a detonation wave, coming from the detonator can travel from the inlet zone 21 to the outlet zone 22 of the housing 20 through the hole 31 in the rod 30.

Pivoting of the rod 30 is driven by an electric motor 40 controlled by a control unit 43. The motor used is in particular a motor of limited stroke, specifically a rotary voice coil type motor.

As shown in FIG. 1, the stator 41 of the electric motor 40 is situated outside the housing 20. However its rotor 42 is connected entirely inside the space defined by the housing, the housing 20 thus being interposed between the rotor 42 and the stator 41.

When a pyrotechnic stream penetrates via the inlet zone 21 of the housing. 20, the inside space 23 is subjected to extreme conditions of pressure and temperature. The stator together with all of the connecting elements associated therewith is not subjected to such conditions, and thus remains preserved.

In this example, the rotor 42 comprises a magnetic drive member 44 in the form of a permanent magnet 44 surrounding the rod 30 and constrained to rotate together therewith.

The stator 41 in this example comprises two coils 45 (only one of which is visible in FIG. 1) wound around a ring (not shown) of ferromagnetic material surrounding the casing, the two coils being adapted to be powered with non-alternating electricity (DC or chopped) by the control unit 43.

The stator 41 is arranged at the periphery of a portion of the housing 20 surrounding the magnetic drive member 44.

Electrically powering the coils of the stator 41 induces a magnetic field moving around the axis X of the magnetic drive member of the rotor 44, and of the rod 30 that is secured thereto.

The amplitude of the pivoting of the rod 30 is limited by at least two mechanical abutments 26 and 28 projecting from the inside face of the housing 20.

By way of example, in order to co-operate with these abutments, the rod 30 may include at least one positioning lug 32 projecting from its outside face.

In the example shown, the rod 30 can travel through about 90° between its two extreme positions, in which it comes into abutment.

Figure 4A:
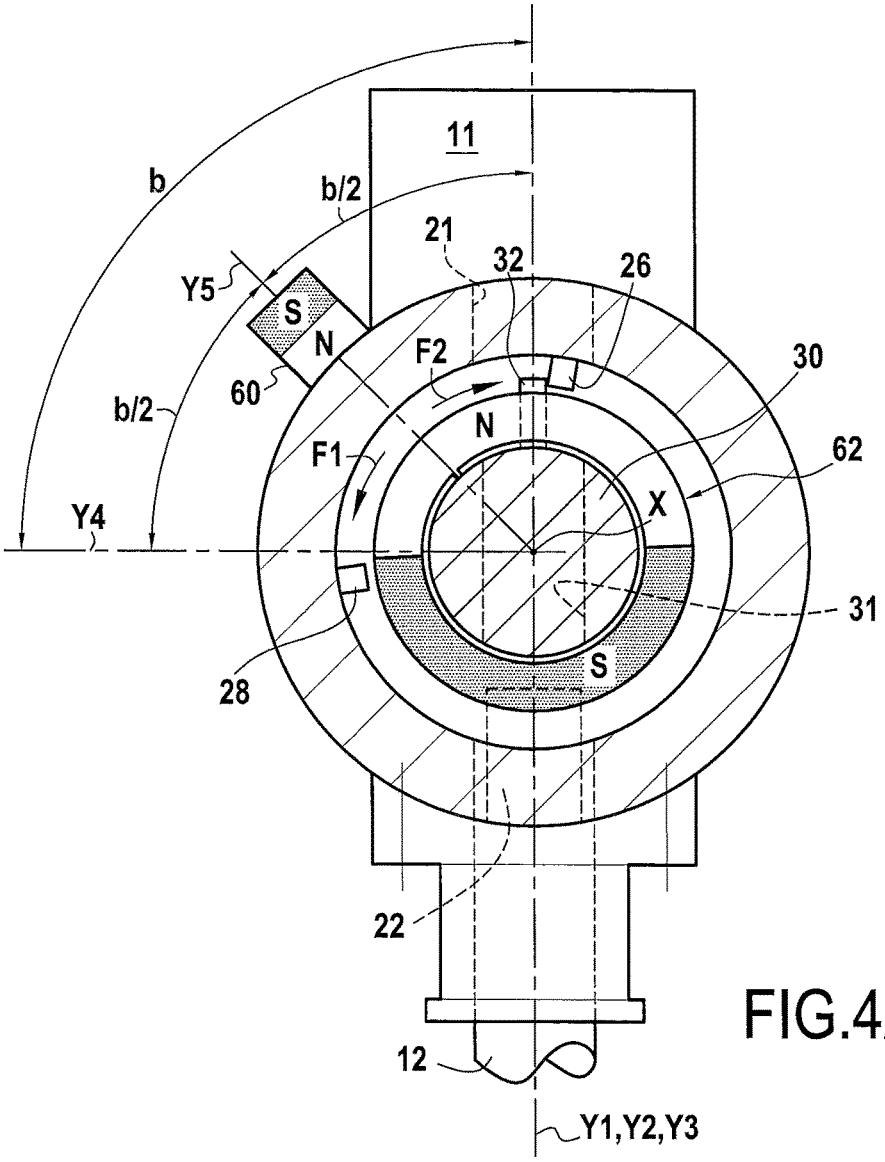
FIG. 4A is a diagrammatic view on plane A-A in FIG. 1, showing the position locking system of the arming element.

FIGS. 1 and 4A show the rod 30 in its armed position: the lug 32 is in contact with the first abutment 26.

Figure 2:
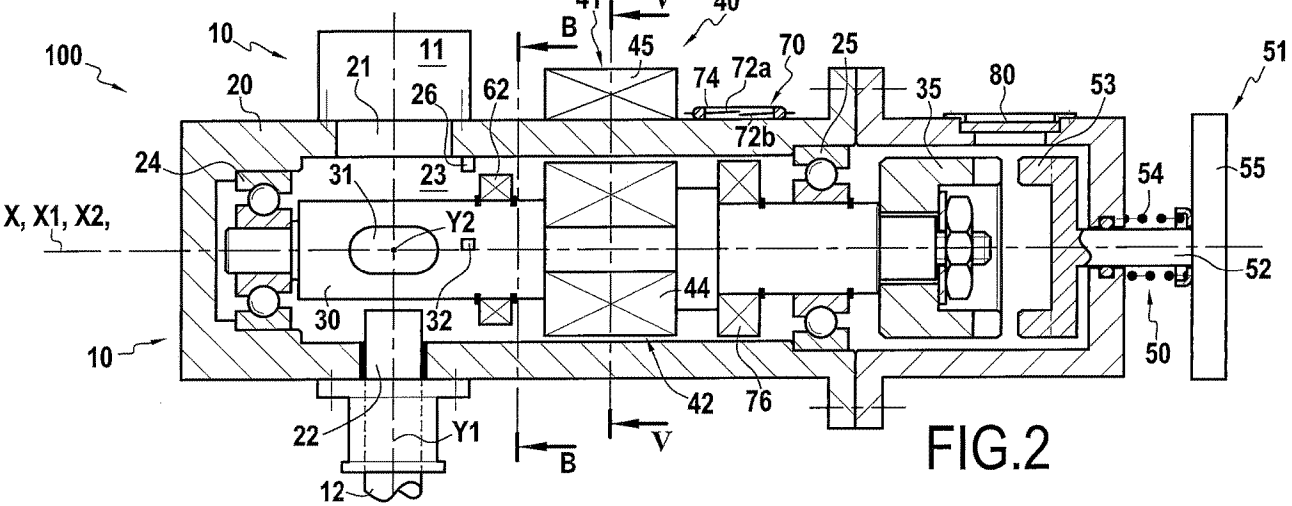
FIG. 2 shows the FIG. 1 pyrotechnic chain, the arming element being shown in its disarmed position.
Figure 4B:
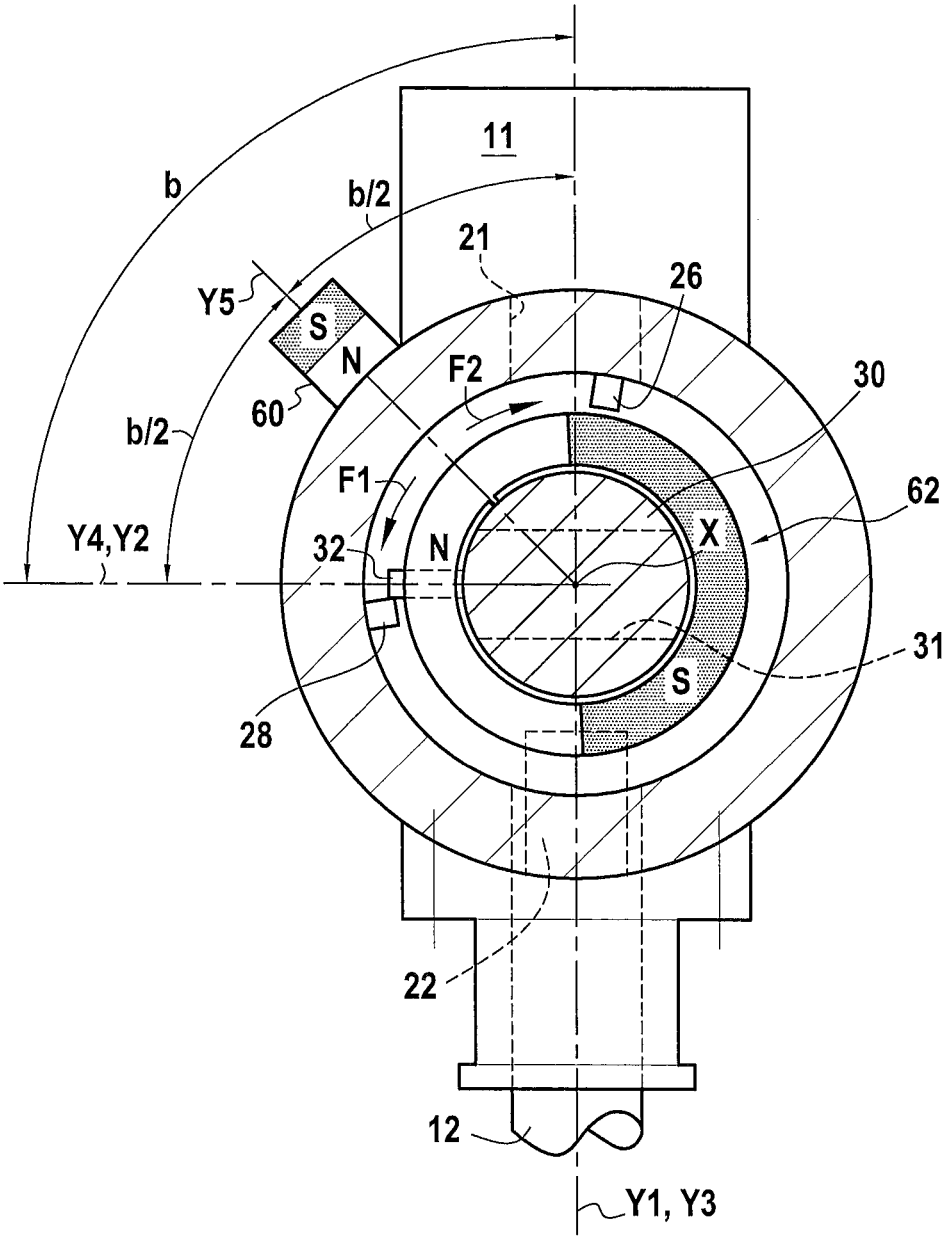
FIG. 4B is a diagrammatic view on plane B-B of FIG. 2.

After pivoting in the disarming direction F1 shown in FIG. 4A through an angle b representing about one-quarter of a turn, the rod 30 is in its disarmed position as shown in FIGS. 2 and 4B: the lug is in contact with the second abutment 28.

It can be understood that electrically powering the stator 41 enables the rod 30 to be moved between its armed and disarmed positions. In order to ensure that the rod 30 is held in its position as previously set by means of the electric motor 40 after the stator 41 is no longer producing a magnetic field (when the coils are no longer electrically powered), the arming and safety device 10 includes a system for locking the rod in position.

In this example, this position locking system comprises at least one primary magnet 62 secured to the rod 30, and a magnetic assembly constituted by a secondary magnet 60 that is stationary relative to the housing 20, the secondary magnet 60 being configured to repel the primary magnet 62 in a bistable system towards a first angular position (shown in FIG. 4A) in which the rod 30 is in its armed position, or else towards a second angular position (shown in FIG. 4B) in which the rod 30 is in its disarmed position.

In the example shown, the secondary magnet 60 is a permanent magnet situated on the periphery of the housing 20 and the primary magnet 62 is a permanent magnet surrounding the rod 30, and secured thereto.

As shown in FIGS. 4A and 4B, the main axis along which the north and south poles of the primary magnet 62 are arranged extends in a radial direction Y3 when the primary magnet 62 is in its first position (corresponding to an armed position of the arming element 30), and in a radial direction Y4 when the primary magnet is in its second position (corresponding to a disarmed position of the arming element 30), the directions Y3 and Y4 forming between them the angle b (substantially equal to 90°).

The secondary magnet 60 is positioned relative to the rod 30 in such a manner that the north and south poles are aligned on a radial direction (Y5) that is intermediate between the directions Y3 and Y4.

More particularly, the radial direction Y5 co-operates with each of said directions Y3 and Y4 to form an angle less than b, preferably substantially equal to b/2.

In the example shown, the secondary magnet 60 is thus positioned angularly between the two mechanical abutments 26 and 28, preferably halfway between said abutments.

The pole of the secondary magnet facing towards the rod 30 is referred to as its main pole. In this example, it is a north pole.

Furthermore, the primary magnet 62 is mounted in such a manner that when its poles are aligned on the same radial direction Y5 as the secondary magnet 60 and when simultaneously the rod 30 is situated in an angular position intermediate between its armed and disarmed positions (preferably halfway), the pole of the primary magnet 62 facing towards the secondary magnet 60 is the same as the main pole of the secondary magnet (its north pole in this example).

Naturally, the north poles of the two magnets 60 and 62 repel each other. Since the secondary magnet 60 is stationary relative to the housing 20, it naturally constrains the primary magnet 62 to move away from its unstable position (which is located halfway between its first and second positions).

Consequently, when the rod 30 is in its disarmed position, the repulsion between the primary and secondary magnets 60 and 62 hold it in this position. The same applies when the rod 30 is in its armed position.

As shown in FIG. 1, the arming and safety device 10 includes a magnetic switch 70 situated outside the housing 20 and adapted to be actuated as a function of the position of the rod 30 by at least one permanent magnet 76, which magnet is secured in this example to the rod 30.

By way of example, the magnetic switch 70 may be a switch of the flexible blade type, commonly known as a reed switch.

As is also known, such a switch has two magnetized flexible contacts 72*a* and 72*b* that are placed in a glass bulb 74. In the presence of a magnetic field, the contacts 72*a* and 72*b* are attracted towards each other. They move towards each other until they touch, thus allowing an electric current to pass. When the magnetic field ceases, the contacts 72*a* and 72*b* are no longer magnetized and they move apart because of their resilience, so that the current is interrupted.

Depending on the angular position of the rod 30 and on the orientation of the permanent magnet 76, the switch 70 is either on or off. It is therefore possible very easily, merely by visual inspection, to determine whether the rod 30 is in its armed position or its disarmed position.

In the example shown, the arming and safety device 10 also has a manual drive system 50 configured to drive the arming element 30.

In this example, the manual drive system 50 comprises a handle 51 mounted to pivot about the pivot axis X of the rod 30 and movable in translation along the direction of the axis between an active position in which it is coupled in rotation with said rod 30, and a passive position in which it is not coupled to the rod 30.

The handle 51 has a shaft 52 mounted through an orifice 29 in the housing 20 and free to slide and to pivot inside the orifice, together with a grip portion 55 that is fastened to the portion of the shaft 52 that projects outside the housing.

At the opposite end of the shaft 52, the handle 51 also has a coupling system 53 adapted to co-operate by complementary shapes with corresponding coupling system 35 of the rod 30 so as to constrain the rod 30 and the handle 51 together in rotation.

In nominal operation of the arming and safety device 10, the handle 51 is continuously urged towards its passive position by a spring 54 that is installed between said handle (here the grip portion 55) and the outside surface of the housing 20.

In nominal operation, pivoting of the rod 30 is thus not transited to the handle 51.

Nevertheless, in an emergency, the handle 51 can be moved manually towards its active position. It suffices to exert a force thereon opposing the force of the spring 54 so that the shaft 52 moves in translation along the longitudinal direction X until the respective co-operating means of the handle 51 and of the rod 30 co-operate to constrain these two elements together in rotation.

Figure 3:
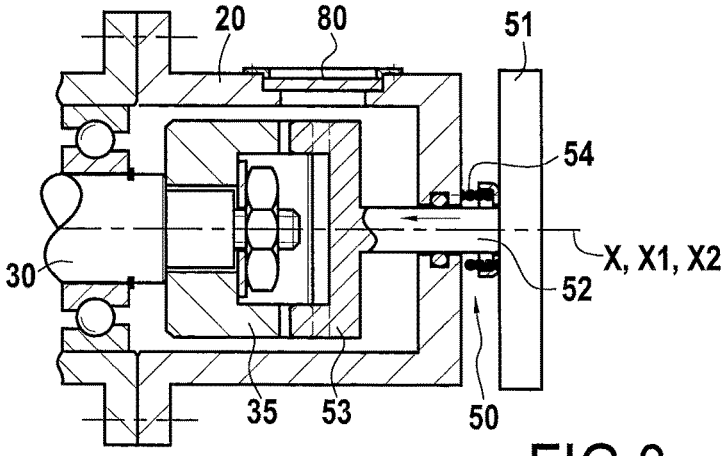
FIG. 3 shows the manual drive handle coupled to the arming element, in emergency operation.

As shown in FIGS. 1, 2, and 3, the housing 20 may be provided with a porthole or window 80 making it possible to see whether the handle 51 is in its passive or active position, and to deduce therefrom whether the arming element is in its armed or disarmed position.

The first embodiment as described above with reference to FIGS. 1 to 4B is nevertheless not limiting.

Figure 5:
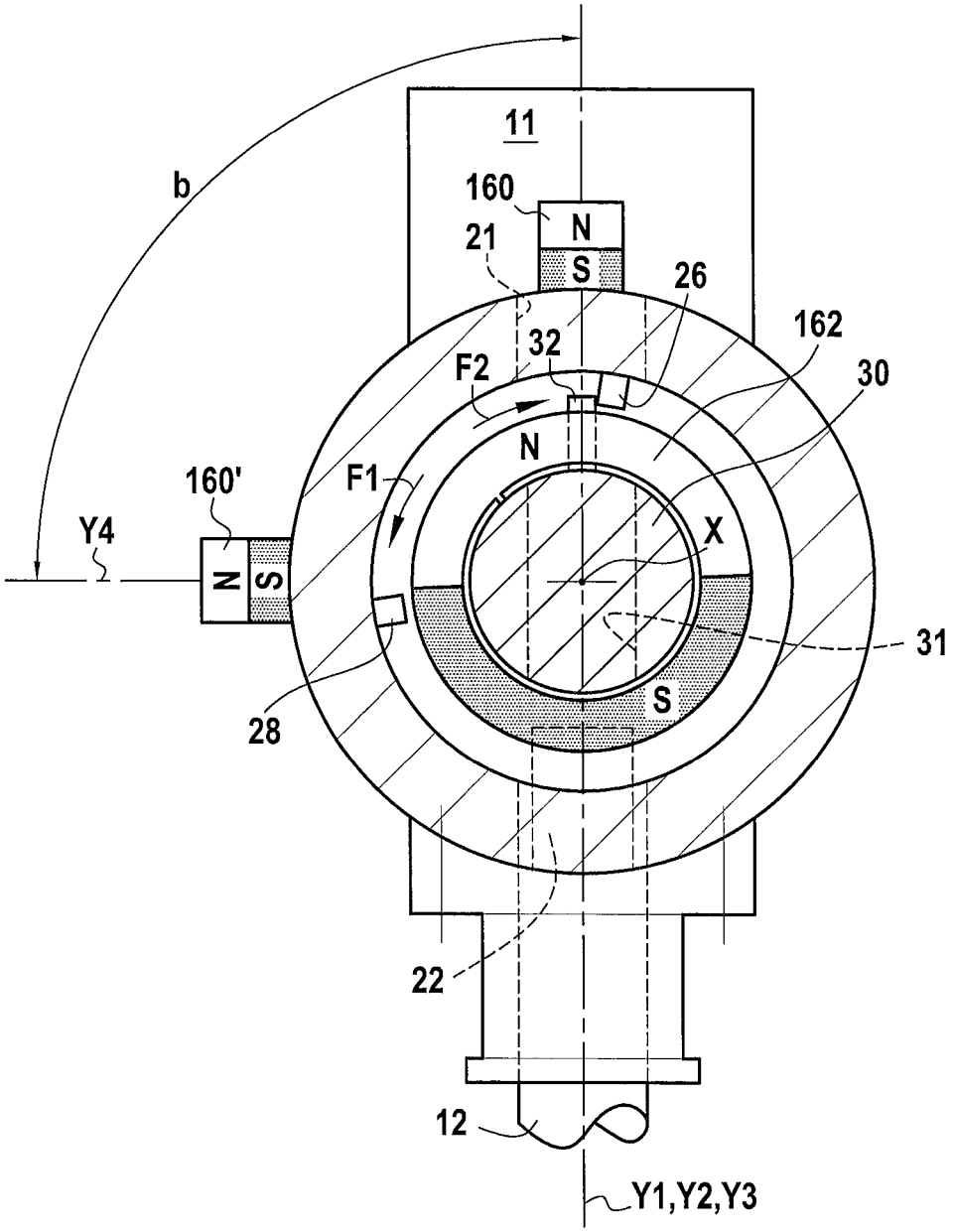
FIG. 5 is a diagrammatic view on plane A-A of FIG. 1 showing a second embodiment of the position locking system of the arming element.

In particular, FIG. 5 shows a second embodiment of the system for locking the arming element 30 in position that operates by magnetic attraction and not by repulsion like the system described with reference to the first embodiment.

The other elements of the device are not changed relative to the above-described first embodiment so they are not described again below.

In this example, the locking system comprises at least one primary magnet 162 that is secured to the rod 30, and a magnetic assembly now comprising two secondary magnets 160 and 160' that are fastened relative to the housing 20, the secondary magnets 160 and 160' being configured to attract the primary magnet 162 in a bistable system towards a first angular position (shown in FIG. 5) in which the rod 30 is in its armed position, or towards a second angular position in which the rod 30 is its disarmed position.

In the example shown, each secondary magnet 160, 160' is a permanent magnet situated on the periphery of the housing 20, and the primary magnet 162 is a permanent magnet surrounding the rod 30 and secured thereto.

The primary magnet 162 is installed in such a manner that when it is in its first position or its second position its (north) pole facing towards the nearer secondary magnet 160 or 160' is opposite to the (south) main pole of the secondary magnet.

Naturally, the south poles of the secondary magnets 160, 160' attract the north pole of the primary magnet 162. Since the secondary magnets 160 and 160' are stationary relative to the housing 20, they naturally urge the primary magnet 162 towards one of its two stable positions.

Consequently, when the rod 30 is in its armed position, the attraction between the primary magnet 162 and the secondary magnet 160 holds it in this position. In the same manner, when the rod 30 is in its disarmed position, the attraction between the primary magnet 162 and the secondary magnet 160' holds it in position.

Figure 6:
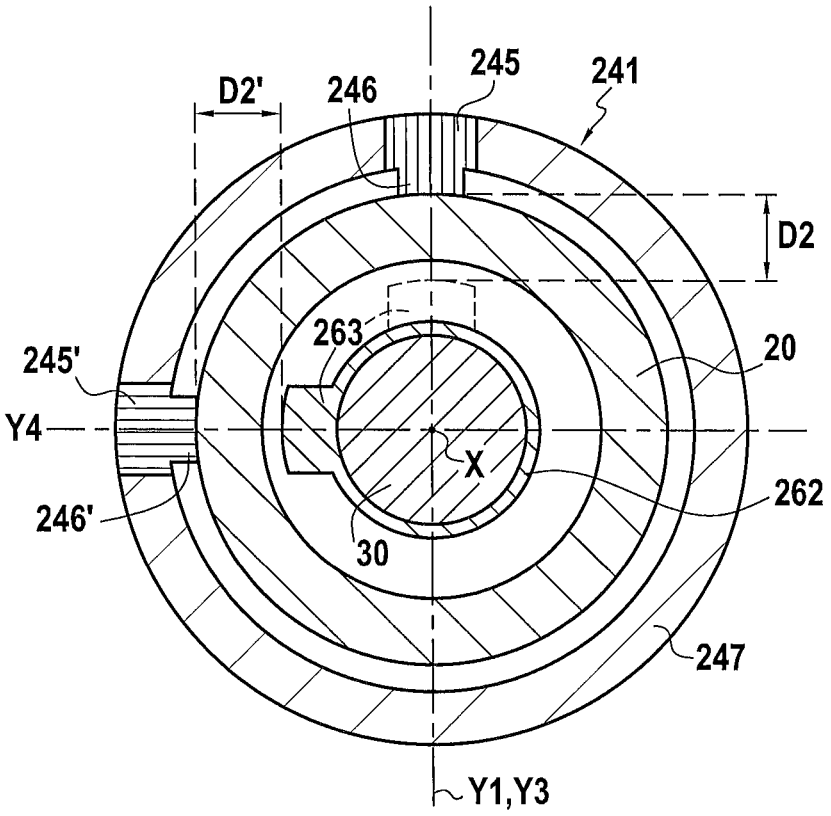
FIG. 6 is a diagrammatic section view on plane V-V of FIG. 2, showing a third embodiment of the position locking system of the arming element.

FIG. 6 shows a third embodiment of the system for locking the arming element 30 in position making use of the cogging torque of the electric motor, as described below.

Since the other elements of the device are unchanged relative to the above-described first embodiment, they are not described again below.

In this example, the locking system comprises a primary magnet 262 secured to the arming element 30 and having an indexing portion 263.

In this particular example, the primary magnet 262 is the magnetic drive member of the rotor, it is generally cylindrical in shape, and the indexing portion 263 is a lug projecting from its outside face.

In this example, the stator 41 comprises a ring of ferromagnetic material 247 surrounding the housing 20 and provided with first and second projections 246 and 246' extending radially towards the inside of the ring 246. In this example, the projections form teeth or cogs.

A coil 245, 245' is wound around each projection 246, 246', each coil 245 being adapted to be powered with non-alternating electricity (DC or chopped) by the control unit (not shown).

The indexing portion 263, and the first and second projections 246 and 246' are arranged in such a manner that when the indexing portion 263 is facing the first projection 246, the arming element 30 is in its armed position, and when the indexing portion 263 is facing the second projection, the arming element 30 is in its disarmed position.

In this example, the first and second projections 246 and 246' are arranged on radial directions that form between them an angle of about 90°.

As can be seen in FIG. 6, the distance D2 measured radially between the primary magnet 262 and the stator 241 is minimized when the indexing portion 263 is facing one or the other of the projections 246 and 246' of the stator 241.

It is known that air presents reluctance that is greater than that of the ferromagnetic material of the ring 247 of the stator 241, and also that the rotor tends naturally to take up a position in which the reluctance of the magnetic circuit is minimized.

When the indexing portion 263 is positioned facing a projection 246, 246', the path traveled in air by the magnetic induction from the rotor is shorter than the path traveled by the magnetic induction when the indexing portion is facing a stator portion that does not have a projection. In such a position, the reluctance of the magnetic circuit is therefore diminished.

In the absence of the coils 245 and 245' of the stator 241 being powered electrically, the indexing portion 263 thus tends naturally to align itself with the teeth 246 or 246' of the stator and to remain in alignment with them, under the effect of a torque of the electric motor known as its "cogging torque". The aligned positions of the primary magnet 262 thus coincide with the armed and disarmed position of the arming element 30, so the cogging toque serves to lock the arming element 30 in these two positions.

The invention claimed is:

1. An arming and safety device for a pyrotechnic chain, said device comprising:

a housing presenting an inlet zone for a pyrotechnic stream and an outlet zone for said pyrotechnic stream;

an arming element housed in the housing, between the inlet and outlet zones, and adapted to move between a disarmed position in which it blocks the passage of the pyrotechnic stream between the inlet zone and the outlet zone, and an armed position in which it allows the pyrotechnic stream to pass between the inlet zone and the outlet zone; and a drive system configured to drive the arming element between its armed position and its disarmed position, the drive system comprising an electric motor having a rotor and a stator, wherein the stator of the electric motor is situated outside the housing, and the rotor is contained entirely inside the housing.

2. The device according to claim 1, wherein the housing is fluid-tight.

3. The device according to claim 1, wherein the arming element is mounted to pivot about an axis.

4. The device according to claim 3, wherein the arming element is pierced by a through hole adapted to occupy a position facing the inlet and outlet zones when the arming element is in its armed position, said hole allowing the pyrotechnic stream coming from the inlet zone to pass towards the outlet zone.

5. The device according to claim 1, further comprising an abutment system adapted to block movement of the arming element so that the arming element is in abutment when in its armed position and when in its disarmed position.

6. The device according to claim 1, further comprising a position locking system configured to lock the arming element both in its disarmed position and also in its armed position.

7. The device according to claim 6, wherein the locking system comprises a primary magnet secured to the arming element, and a magnetic assembly that is stationary relative to the housing, the magnetic assembly being adapted to co-operate with the primary magnet to urge it magnetically in a bistable system towards a first position in which the arming element is in its armed position or else towards a second position in which the arming element is in its disarmed position.

8. The device according to claim 1, further comprising at least one magnetic switch situated outside the housing and adapted to be actuated as a function of the position of the arming element by at least one permanent magnet secured to or forming part of the arming element.

9. The device according to claim 1, further comprising a manual drive system configured to drive the arming element, the manual drive system being adapted to be decoupled from the arming element in at least one configuration.

10. The device according to claim 9, wherein the arming element is mounted to pivot about an axis, and the manual drive system comprises a handle mounted to pivot about an axis parallel to the pivot axis of the arming element and movable in translation along the direction of said axis between an active position in which it is coupled in rotation with the arming element and a passive position in which it is not coupled to the arming element.

11. The device according claim 10, wherein the manual drive system further comprises at least one spring continuously urging the handle towards its passive position.

12. A pyrotechnic chain comprising an arming and safety device according to claim 1, an upstream segment of the pyrotechnic chain being coupled to the inlet zone of the housing, and a downstream segment of said pyrotechnic chain being coupled to the outlet zone of the housing.

13. The pyrotechnic chain according to claim 12, wherein the upstream segment of the pyrotechnic chain comprises a detonator.

14. The pyrotechnic chain according to claim 12, wherein the downstream segment of the pyrotechnic chain comprises a detonation transmission line.

* * * * *